US007658384B2

(12) United States Patent
Nakamoto et al.

(10) Patent No.: US 7,658,384 B2
(45) **Date of Patent: *Feb. 9, 2010**

(54) DIE-ROLLING DEVICE AND GAME

(75) Inventors: Glen Nakamoto, Covina, CA (US); Jeannie Burns Hardie, Gardena, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/872,500

(22) Filed: Oct. 15, 2007

(65) Prior Publication Data

US 2008/0029960 A1 Feb. 7, 2008

Related U.S. Application Data

(63) Continuation of application No. 11/261,364, filed on Oct. 28, 2005, now abandoned, which is a continuation of application No. 10/877,430, filed on Jun. 25, 2004, now abandoned, which is a continuation of application No. 10/139,148, filed on May 2, 2002, now Pat. No. 6,755,416.

(60) Provisional application No. 60/288,625, filed on May 3, 2001.

(51) Int. Cl.
*A63F 3/00* (2006.01)

(52) U.S. Cl. ..... 273/243

(58) Field of Classification Search ..... None
See application file for complete search history.

(56) References Cited

U.S. PATENT DOCUMENTS 484,115 A 10/1892 Saxton
539,121 A 5/1895 Meyer
1,538,455 A 5/1925 Winkel
1,562,866 A 11/1925 Burgess
1,592,813 A 7/1926 Whitney
2,072,605 A 3/1937 Palmer
2,452,730 A 11/1948 Carter
2,528,029 A 10/1950 Brown
3,085,709 A 4/1963 Klein
3,119,621 A 1/1964 Bookman
3,124,359 A 3/1964 Bottini
3,134,486 A 5/1964 Voorhies
3,168,315 A 2/1965 Bookman
3,245,526 A 4/1966 Palmer
3,304,650 A 2/1967 Glass et al
3,322,265 A 5/1967 Collura
3,337,033 A 8/1967 Cote
3,345,759 A 10/1967 Harris
3,547,444 A 12/1970 Williams et al
3,638,947 A 2/1972 Hardesty
3,724,847 A 4/1973 Compton
3,734,501 A 5/1973 La Monica
3,759,521 A 9/1973 Breslow et al (Continued)

*Primary Examiner*—Gene Kim
*Assistant Examiner*—Dolores Collins
(74) *Attorney, Agent, or Firm*—Edell, Shapiro & Finnan LLC

(57) ABSTRACT

A method of playing a game. A face of a die may be selected, and a marker may be moved to a position on a game board according to the face selected. A request for a player response may be selected from a set of text-based requests, and an interval associated with the player response may be timed.

19 Claims, 4 Drawing Sheets

U.S. PATENT DOCUMENTS 3,807,739 A 4/1974 Henley et al
3,831,945 A 8/1974 Scherini
3,837,651 A 9/1974 Shute
3,858,333 A 1/1975 Kopp
4,049,277 A 9/1977 Carlsson, Jr. et al.
4,055,348 A 10/1977 Marzoni, Jr.
4,140,317 A 2/1979 Ramney
4,146,235 A 3/1979 Brautovich
4,148,488 A 4/1979 Kohlhagen
4,176,469 A 12/1979 Timco
4,206,925 A 6/1980 Goldfarb et al.
4,273,337 A 6/1981 Carrera et al.
4,331,333 A 5/1982 Willcocks
4,367,955 A 1/1983 Ballew
D270,921 S 10/1983 Morgan
4,527,800 A 7/1985 Samansky
4,550,915 A 11/1985 Meyer
4,632,397 A 12/1986 Rivkin
4,643,693 A 2/1987 Rubinstein
4,648,601 A * 3/1987 Carmichael ..... 273/241
4,666,161 A 5/1987 Elesie et al.
4,703,930 A 11/1987 Gilbert
4,735,419 A 4/1988 Koca
4,813,678 A 3/1989 Collazo et al.
4,830,379 A * 5/1989 Richard et al. ..... 273/244
4,890,838 A 1/1990 Rudell et al.
4,900,033 A 2/1990 Campos et al.
4,932,667 A 6/1990 Gorski et al.
4,932,668 A * 6/1990 Stewart ..... 273/256
4,948,146 A 8/1990 Snyder et al.
4,966,366 A 10/1990 Mercado-Torres
4,984,805 A 1/1991 Medlock
4,991,847 A 2/1991 Rudell et al.
5,009,429 A * 4/1991 Auxier ..... 273/240
5,009,431 A 4/1991 Goldfarb et al.
5,022,654 A 6/1991 Berger
5,024,440 A 6/1991 Tidalgo et al.
5,076,588 A 12/1991 Minh
D324,080 S 2/1992 Galenza
5,115,965 A 5/1992 Girona Alepuz
5,125,660 A 6/1992 Stahl
5,145,184 A * 9/1992 Yearick et al. ..... 273/248
5,224,708 A 7/1993 Gathman et al.
5,295,834 A 3/1994 Saunders
5,308,079 A 5/1994 Dreznick et al.
5,322,210 A 6/1994 Chila et al.
5,332,227 A 7/1994 Passero
5,405,140 A 4/1995 Terlinden et al.
5,445,375 A 8/1995 Sweeny
5,449,174 A 9/1995 Criner
5,472,207 A 12/1995 Sullivan, Jr. et al.
5,526,326 A 6/1996 Fekete et al.
5,579,990 A 12/1996 Durand
5,607,160 A 3/1997 Stevens et al.
5,645,280 A * 7/1997 Zelmer ..... 273/256
5,678,825 A 10/1997 Clayton
5,738,354 A * 4/1998 Easley ..... 273/249
5,782,471 A 7/1998 Bautista et al.
5,810,359 A * 9/1998 Wilkins et al. ..... 273/256
5,876,211 A 3/1999 Schmoyer et al.
5,885,157 A 3/1999 Harada et al.
5,913,518 A * 6/1999 Demlow ..... 273/247
5,918,881 A 7/1999 Kirby
5,988,642 A 11/1999 Ziemba et al.
6,036,010 A 3/2000 Seyffert et al.
6,120,296 A 9/2000 Lim
6,123,333 A 9/2000 McGinnis, Sr. et al.
6,164,650 A * 12/2000 Wilkins et al. ..... 273/256
6,176,489 B1 1/2001 Astaneha
6,299,168 B1 10/2001 Tyson
6,352,259 B1 * 3/2002 Israel ..... 273/244
6,409,171 B1 6/2002 Schultz et al.
6,422,561 B1 7/2002 Schroeder
6,431,545 B1 * 8/2002 Kuhne ..... 273/272
6,655,686 B1 12/2003 Morgan
6,755,416 B2 * 6/2004 Nakamoto et al. ..... 273/145 C
6,761,358 B2 7/2004 Hallett
6,896,262 B2 5/2005 Loveman et al.
2005/0133995 A1 6/2005 Walker et al.
2006/0022407 A1 2/2006 Jensen

* cited by examiner

DIE-ROLLING DEVICE AND GAME

CROSS-REFERENCES TO PRIORITY APPLICATIONS

This application is a continuation application of U.S. patent application Ser. No. 11/261,364, entitled "Die-Rolling Device and Game," filed Oct. 28, 2005, which is a continuation of U.S. patent application Ser. No. 10/877,430 filed on Jun. 25, 2004.

U.S. patent application Ser. No. 10/877,430, in turn, is a continuation of U.S. patent application Ser. No. 10/139,148 filed on May 2, 2002, and issued as U.S. Pat. No. 6,755,416 on Jun. 29, 2004, which claims the benefit under 35 U.S.C. § 119(e) of U.S. Provisional Patent Application Ser. No. 60/288,625 filed on May 3, 2001.

Each of the above-identified patent applications and the issued patent is incorporated herein by reference in its entirety for all purposes.

FIELD OF THE INVENTION

The invention relates to games for amusement.

BACKGROUND

Many board games rely on random selection of outputs to direct a player's actions. For example, movement of a player's marker on a game board may be dictated by a card drawn from a stack of cards, an output selected by spinning a needle or a wheel, or an output obtained by rolling a die or dice, among others. Of the many possible methods for selecting a random output, rolling a die or dice may be most widely used for game play because this method offers advantages over other methods. Specifically, die rolling requires no previous preparation, unlike a stack of cards that is shuffled, is mechanically simple, and provides a series of random outputs that are independent of each other.

Die rolling may suffer from some disadvantages. Typically, one or more dies are thrown or dropped from a player's hand or a container in a generally uncontrolled fashion. As a result, an errant die may collide with, and disrupt, features of a game, such as the position of player markers. Alternatively, or in addition, the errant die may travel away from the game site, requiring retrieval.

Some of the disadvantages of die rolling have been overcome by constraining die movement within an enclosure, to produce a die-rolling device. Examples of such devices are found in U.S. Pat. Nos. 3,119,621; 3,168,315; 4,049,277; 4,148,488; 4,632,397; 4,643,693; 5,022,654; and 5,445,375, the disclosures of which are incorporated herein by reference.

A commercial embodiment of U.S. Pat. No. 3,168,315 is Mattel's MAGIC 8-BALL® toy in which rolling a die selects an output from a set of opposite responses. The original MAGIC 8 BALL® toy is a flat-bottomed, plastic replica of a pool or billiard "8-ball" that includes a viewing window to an interior, dye-filled fluid chamber. Within the chamber is a floating polyhedron with a distinct response on each triangular face of the polyhedron. The selected face of the die represents responses that are generally affirmative, negative, or ambiguous, with the suggestion to ask the MAGIC 8 BALL® toy again. Inverting the toy to allow the viewing window to face upward causes one of the faces of the floating polyhedron to contact the window and become visible, thus selecting the associated response on that side for viewing and reading.

In addition to die rolling, games may employ a time interval to limit or regulate a player's action. Thus, games may include a timer to measure the time interval. Disclosures of various timers used in games are found in U.S. Pat. Nos. 3,304,650; 3,724,847; 4,890,838; and 5,607,160, the disclosures of which are incorporated herein by reference.

The advantages of the present invention will be understood more readily after a consideration of the drawings and the Detailed Description.

SUMMARY

The present teachings provide a method of playing a game. A face of a die may be selected, and a marker may be moved to a position on a game board according to the face selected. A request for a player response may be selected from a set of text-based requests, and an interval associated with the player response may be timed.

DETAILED DESCRIPTION

Figure 1:
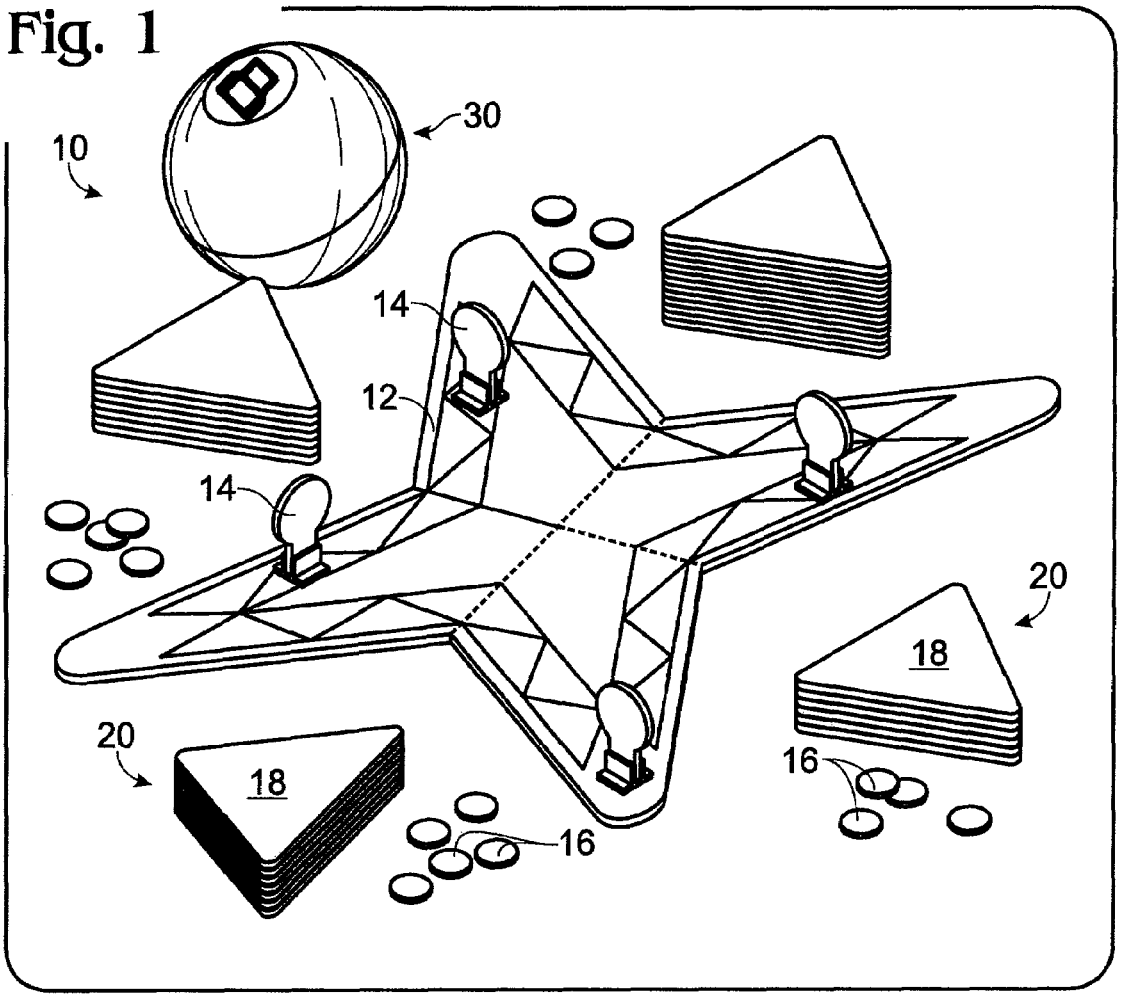
FIG. 1 is a perspective environmental view of an embodiment of a game that includes a die-rolling device.

Referring to FIG. 1, a game 10 is shown to include a game board 12, player markers 14, tokens 16, and activity cards 18 selected from one of plural card stacks 20. A die-rolling device 30 selects random outputs, as described below, with the outputs directing movement of player markers 14 around game board 12, transactions with tokens 16, and/or other decision points during game play. Die-rolling device 30 also may measure time intervals during game play.

Figure 2:
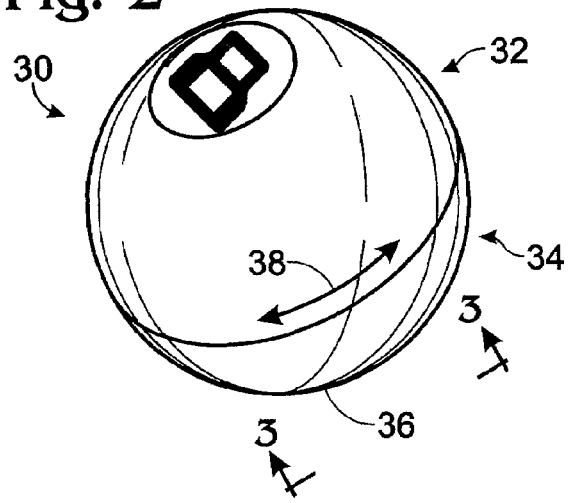
FIG. 2 is a perspective view of the die-rolling device of FIG. 1.

FIG. 2 shows an enlarged view of die-rolling device 30. Die-rolling device 30 may be generally spherical in shape. In particular embodiments, the die-rolling device may be a replica of a billiard ball, such as an eight-ball. However, in other embodiments device 30 may assume any suitable shape, such as polyhedral, cubical, cylindrical, hemispherical, an animal, a character (for example, a fictitious character, a famous person, etc.), or a recognizable structure or device (such as a building, a plant, a chair, a computer, a telephone, and so on), among others.

Die-rolling device 30 may have upper and lower portions 32, 34. Lower portion 34 may have a flattened region 36 defining a bottom aspect, to abut a flat surface, thus supporting device 30 in an upright, stationary position on a horizontal surface. In device 30, hemispherical upper portion 32 may be rotated relative to lower portion 34, as indicated by arrow 38. This rotation may be used to activate a timing mechanism, as described further below.

Figure 3:
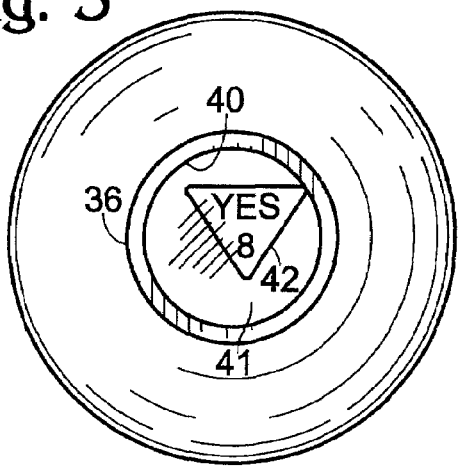
FIG. 3 is a bottom plan view of the die-rolling device of FIG. 1.

FIG. 3 shows a porthole 40 that may be included in flattened region 36. Porthole 40 may define a viewing window 41. The viewing window may be formed of a generally transparent material, such as plastic or glass, and may provide visual access to a die 42 (or dice) carried by die-rolling device 30. In other embodiments, die 42 (or dice) may be viewed from above and/or from the side through a correspondingly disposed viewing window.

Figure 4:
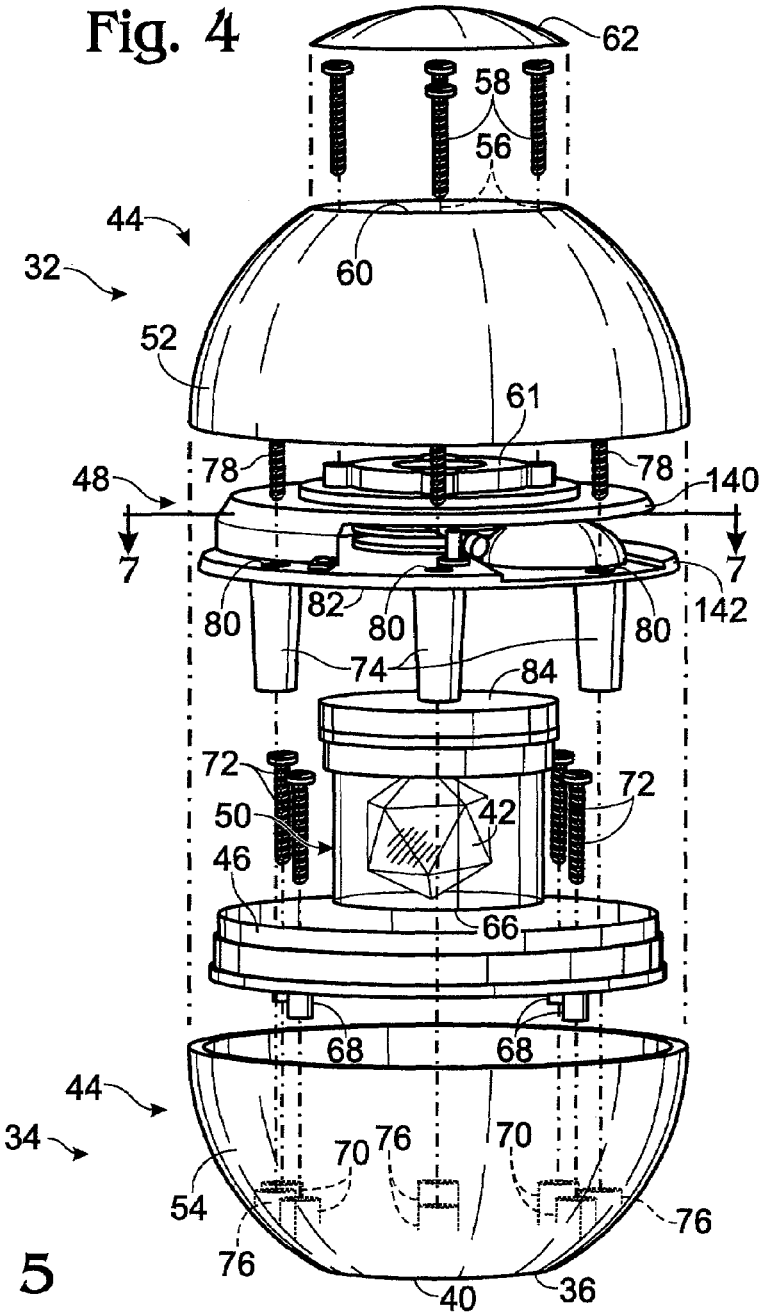
FIG. 4 is an exploded perspective view of the die-rolling device of FIG. 1.

FIG. 4 shows an exploded view of die-rolling device 30. Device 30 may include an external housing 44, an internal frame 46, a timing mechanism 48, and a die-rolling mechanism 50. Timing mechanism 48 and die-rolling mechanism 50 may be integral to device 30, that is, physically coupled to each other within device 30. Furthermore, the timing mechanism may be substantially or completely hidden inside device 30 during normal operation of the device by a person. For example, housing 44 may be opaque to hide the timing mechanism.

External housing 44 may include upper and lower shells 52, 54, respectively, which generally enclose frame 46 and mechanisms 48, 50. Upper shell 52 may include apertures 56 to receive fasteners 58 through an upper flattened region 60. Fasteners 58 may be configured to mount upper shell 52 on disc member 61 of timing mechanism 48. The heads of fasteners 58 may be hidden by a cap 62, providing a contoured surface that smoothly transitions to the exterior surface of upper shell 52. Cap 62 may be attached to upper shell 52 by an adhesive or fasteners, may be pressure-mounted with prongs that snap into recesses or apertures formed in the upper shell, and/or the like. By contrast, lower shell 54 may include a single large aperture that defines an inner perimeter of flattened region 36 and forms porthole 40. The aperture may receive a bottom end region 66 of die-rolling mechanism 50, so that end region 66 is positioned to occupy porthole 40 and to provide viewing window 41. A gasket or washer (not shown) may be interposed between the perimeter of porthole 40 and the circumference of end region 66 to restrict lateral movement of die-rolling mechanism 50.

Frame 46 may guide and facilitate attachment of timing and die-rolling mechanisms 48, 50 to lower shell 54. Frame 46 may include plural downwardly depending legs 68 that may be fastened to upwardly depending projections 70, formed integrally in lower shell 54, using fasteners 72. Supports 74 of timing mechanism 48 may extend through apertures (not shown) formed in frame 46 to meet a second set of integrally formed projections 76 of lower shell 54. Fasteners 78 may be introduced into orifices 80 of supports 74 to mount timing mechanism 48 on lower shell 54. Mounted timing mechanism 48 may hold die-rolling mechanism 50 in position relative to porthole 40 through contact between a bottom surface 82 of the timing mechanism and a top surface 84 of the die-rolling mechanism. In this position, bottom end region 66 occupies porthole 40, forms viewing window 41, and is generally parallel to flattened region 36 of lower shell 54.

Figure 5:
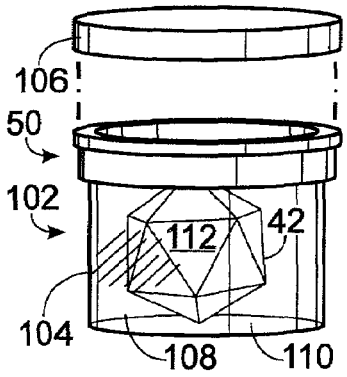
FIG. 5 is an exploded perspective view of an embodiment of a die-rolling mechanism housed in the die-rolling device of FIG. 1.

FIG. 5 shows die-rolling mechanism 50 in a partially exploded view. Die rolling mechanism 50 may carry die 42, or two or more dice, in an enclosure 102. Enclosure 102 may include a vessel portion 104 and a cap portion 106 to form a generally liquid-tight, closed chamber 108 occupied by die 42. In other embodiments, the enclosure may be only partially closed, for example, a cage that retains die 42. Whatever the nature of enclosure 102, die 42 generally is not released from the container during operation of die-rolling mechanism 50. Thus, die 42 remains associated with the die-rolling mechanism.

Enclosure 102 and chamber 108 may contain or include a suitable fluid 110. Suitable fluids may include water or any other nontoxic liquids, and may have a density less than the overall average density of die 42, so that die 42 floats. Fluid 110 may be transparent, and colorless or colored. Fluid 110 may be colored, for example, by addition of a dye. Alternatively, the fluid may be generally opaque or at least appear opaque when viewed from a position external to device 30. In this case, only a portion of die 42 disposed adjacent porthole 40, generally a region of the die abutting viewing window 41, may be easily visible.

The die-rolling mechanism is operated by movement. Movement may include shaking, rotating, inverting, and/or so on. In the depicted embodiment, die-rolling mechanism 50 is operated by inverting device 30 to randomly select one of the faces of die 42.

Die 42 may be generally structured as a polyhedron, with plural sides or faces 112. In the depicted embodiment, die 42 is an icosahedron, with twenty faces. However any desired polyhedron may be used. For example, die 42 be a tetrahedron with four faces, a cube or rhombohedron with six faces, an octahedron with eight faces, a decahedron with ten faces, a dodecahedron with twelve faces, and/or so on. The overall density of die 42 may be less than the density of fluid 110 carried in chamber 108. Accordingly, die 42 may have a hollow core and be filled with gas, fluid 110 or a distinct liquid, or die 42 may have a solid core and be formed of a lower density material, such as a plastic. Alternatively, die 42 may be configured to sink or rest on the bottom of chamber 108. In this case, die 42 may be denser that the fluid in chamber 108, or chamber 108 may include no liquid and instead may be filled with a gas or gas mixture, or formed as a vacuum chamber. Further aspects of forming a die rolling mechanism, including aspects of the die, porthole, chamber, and fluid are included in U.S. Pat. Nos. 3,119,621; 3,168,315; and 4,049,277. The disclosures of these patents are incorporated herein by reference.

Each die may bear and present one, two, or more sets of visual indicators or outputs on faces 112. A visual indicator or output generally includes any discrete response conveyed to a player by visual inspection of a die face, generally selected from one of plural related responses (a set of related outputs) carried on different faces of the die. For example, a visual indicator may be selected by a die face from one of two, three, four, or more members of a first set. The first set may correspond to numbers or integers (either numerical symbols and/or countable members, such as dots), colors, shapes (such as circles, triangles, squares, ovals, etc.), objects (such as images of animals, plants, people, buildings, cartoon characters, weapons, etc.), symbols or groups of symbols (such as letters, words, phrases, etc.), and/or the like, presented by the faces of the die. In some embodiments, a visual indicator may correspond to a set of opposites or opposite pairs, and, optionally, additional indefinite responses (such as "roll again," "try again," or no response). Exemplary opposites may include yes/no, black/white, up/down, in/out, left/right, and so on, and may include distinct variations thereof, with substantially similar meaning, on distinct die faces. For example, affirmative answers corresponding to "yes" may be signified on distinct faces of a die by "very likely," "affirmative," "it is certain," "signs point to yes," "si," "positive," "outlook good," "without a doubt," etc. Similarly, negative answers corresponding to "no" may be signified by "not likely," "don't count on it," "nein," "absolutely not," "don't bank on it," "negative," etc. In some embodiments, the faces of the die may bear and present two or more distinct sets of outputs (visual indicators). For example, one, two or more faces of the die each may bear both a member of a first set, corresponding to a set of numbers, colors, shapes, letters, objects, words, or symbols, and a member of a second set corresponding to a set of opposites.

Figure 6:
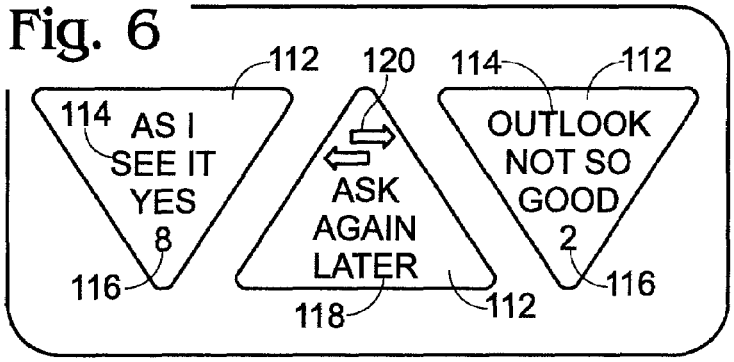
FIG. 6 is a combined view of three different faces of a die used in the die-rolling mechanism of FIG. 5.

FIG. 6 shows representative visual indicators that die 42 may bear on faces 112. Visual indicators may be formed on die faces by any suitable mechanism, including printing, molding, embossing, stamping, lithography, and/or so on. Faces 112 on die 42 may bear a visual indicator 114 corresponding to a member of a set of opposites (in this case, yes/no responses), and a numerical output 116. Visual indicator 114 may correspond to either an affirmative response (such as, "AS I SEE IT YES") or a negative response (such as, "OUTLOOK NOT SO GOOD"). Numerical output 116 may be a visual indicator that corresponds to a number, typically an integer, for example, an integer selected from the integer set 1 to 6, 1 to 8, 0 to 5, etc.

Other faces of die 42 may bear a visual indicator corresponding to an indefinite output or response 118 (for example, "ASK AGAIN LATER," "TRY AGAIN," "ROLL AGAIN," or a blank or nonsensical die face) and/or a symbol indicating that a player should roll again, in this case arrow pair 120. The indefinite output may relate to one or both of the definite outputs requested by a player. In this case, neither requested output is presented, so the player is directed to select another die face by rolling the die again.

Die-rolling device 30 is shown to have a mechanical timing mechanism 48. However, it should be understood that timing mechanisms generally include any mechanism that measures a user-specified, factory preset, and/or random time interval, and distinctly signals the end of the time interval. Such timing mechanisms may be mechanical or electrical. Mechanical timing mechanisms generally measure the release of stored mechanical energy, for example, a wound spring, through defined movement of mechanism components, for example, regulated rotation of plural meshed gears. Electrical timing mechanisms include any electrically powered timer, such as a battery- or AC-powered mechanical timer, a timer that measures crystal vibrations (such as a quartz timer), digital timers, and/or so on. In each case, the timing mechanism produces a distinct endpoint signal that is detected readily without vigilant visual scrutiny. The endpoint signal may be audible, such as a beep, a buzz, a pop, a chime, a clang, a spoken word or words, musical notes, a song, a bang, and so on. Alternatively, or in addition, the endpoint signal may be visible, such as a flashing light, a continuous light signal, a change in light color, and so on. In some embodiments, the endpoint signal may be an odor, such as a burst of a distinctive smell, or may be detected by tactile senses, such as a burst of hot or cold air.

FIGS. 4 and 7-9 show mechanical timing mechanism 48 of die-rolling device 30. Mechanism 48 includes an axially disposed spring 132 that stores energy when a player sets/winds the timing mechanism, and releases the energy through rotation of intermeshed gear train 134 (see FIG. 7). Spring 132 has a fixed end portion 136 and a movable end portion 138. Fixed end portion 136 is rotationally coupled to lower shell 54 by attachment to plate 140, which is mounted on base 142 (see FIG. 4). Base 142 is mounted on lower shell 54 through supports 74 (see above). By contrast, movable end portion 138 of spring 132 is coupled to main gear 144 of gear train 134. (Main gear 144 is shown in phantom outline because the gear is disposed directly above the views of FIGS. 7-9.) Main gear 144, disc member 61, and upper shell 52 are fixedly coupled to each other and may rotate together about a common axis 145, around which spring 132 is centered. Accordingly, rotation of upper portion 32, which acts as a handle member, relative to lower portion 34, shown at arrow 146, activates or sets timing mechanism 48 by coiling spring 132 more tightly.

Gear train 134 may be structured as follows. Rotation of main gear 144 drives rotation of auxiliary gears 148 of gear train 134. Main gear 144 may include teeth 149 distributed over a portion of its circumference to provide a reproducible extent of effective rotation (winding angle) for the main gear. Alternatively, or in addition, a rotation stop may prevent overwinding and provide a standard angle or rotation of main gear 144 for activation of the timing mechanism. Auxiliary gears 148 may be rotationally mounted on either plate 140 and/or base 142 of timing mechanism 48. First, second, third, and fourth auxiliary gears 150, 152, 154, 156, respectively, may be rotationally coupled to each other and to main gear 144 by a larger cogwheel 158 and a pinion 160 included on each of the auxiliary gears. The gear ratio (cogwheel tooth number to pinion tooth number) on one of the auxiliary gears 148 may be about 2:1 to about 30:1, so that a single rotation of first gear 150 results in about 10-1000 revolutions of fourth auxiliary gear 156. In other embodiments, the timing mechanism may include any suitable number of auxiliary gears and any appropriate gear ratios to measure a desired time interval.

Figure 7:
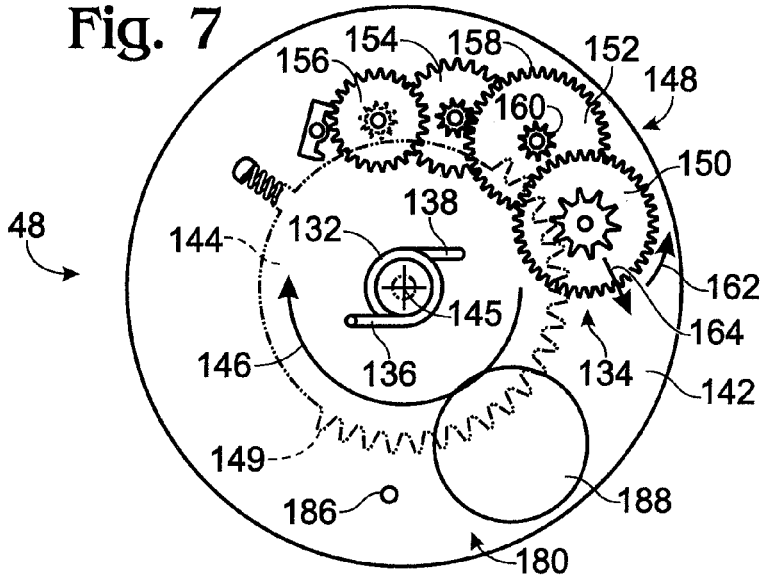
FIG. 7 is a top plan view of selected portions of a timing mechanism used in the die-rolling device of FIG. 1, viewed generally along line 7-7 of FIG. 4, during activation of the timing mechanism.

FIG. 7 shows how gear train 134 moves during activation of timing mechanism 48. Rotation of the handle member or upper portion 32 (see FIG. 2), clockwise in this embodiment and view, rotates main gear 144 clockwise, as shown at 146. First gear 150 is rotated counterclockwise by this winding movement, as shown at 162, but the remainder of auxiliary gears 148 remain stationary, due to a sliding action of first gear 150, shown at 164. An axial portion of first gear 150 occupies a slot rather than a fixed position. Accordingly, clockwise rotation of main gear 144 causes first gear 150 to slide radially, away from, and out of engagement with, pinion 160 of second gear 152.

Figure 8:
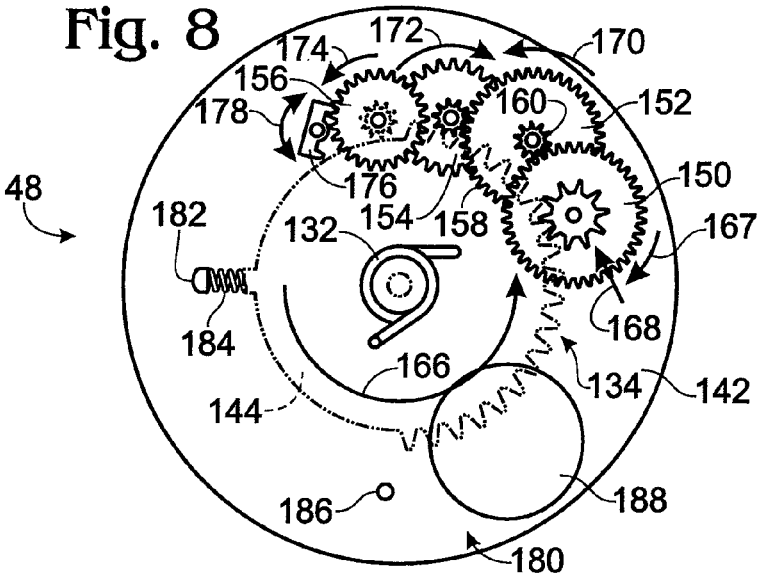
FIG. 8 is a top plan view of the timing mechanism of FIG. 7 during timing of a time interval.

FIG. 8 illustrates how the gears of gear train 134 rotate after activation of timing mechanism 48. Main gear 144 rotates counterclockwise, shown at 166, to release torsional energy from spring 132. This rotational movement of main gear 144 rotates first gear 150 clockwise, as shown at 167, pushing the first gear back into engagement with pinion 160 of second gear 152, as shown at 168, rotating second gear 152 counterclockwise, as shown at 170. In turn, cogwheel 158 of second gear 152 contacts and rotates the pinion of third gear 154 in a clockwise direction, as shown at 172. In turn, the cogwheel of third gear 154 contacts the pinion of fourth gear 156, rotating the fourth gear counterclockwise, as shown at 174. Finally, rotation of fourth gear 156 is governed by pallet 176, which allows rotation of fourth gear 156, in a tooth-by-tooth fashion, with each oscillation of the pallet, shown at 178.

Figure 9:
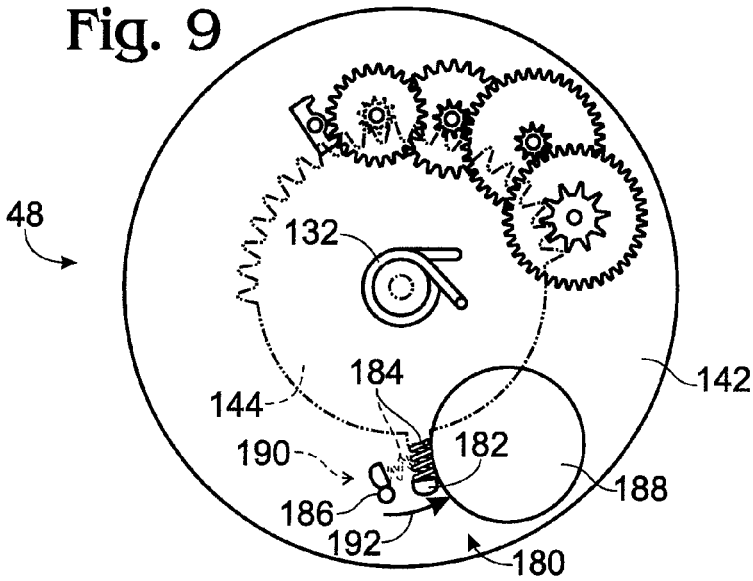
FIG. 9 is a top plan view of the timing mechanism of FIG. 7, signaling the end of a time interval.

FIGS. 8 and 9 show how the endpoint (end) of a time interval may be signaled by a signaling mechanism of timing mechanism 48. In the depicted embodiment, signaling mechanism 180 provides an audible signal, in the form of a bell tone. Signaling mechanism 180 includes a striker 182 flexibly coupled to main gear 144 through a resilient coupler 184, such as a spring. Mechanism 180 also includes a post 186 and a bell 188, each mounted on base 142, in the rotational path of striker 182. As main gear 144 returns to near its original position, striker 182 contacts post 186 and retains striker 182 in contact with the post. Main gear 144 continues its rotation and coupler 184 stretches to hold the striker against the post, shown at 190. However, with sufficient rotation, striker 182 slips past post 186, and coupler 184 returns to its original resting position, shown at 192, snapping striker 182 against bell 188 to sound the bell. Although the audible signal is produced by a bell and a striker, any other suitable mechanical or electrical signaling mechanism may be used.

Timing mechanism 48 may measure any desired time interval. The interval may be a standard, fixed interval of a duration determined during fabrication of the mechanism. For example, the time interval may be about five second to ten minutes, about ten seconds to three minutes, about twenty seconds to one minute, or about thirty seconds. Alternatively, the interval may be a variable interval. The variable interval may be defined by a player, for example, by positioning the handle member of the timing mechanism to one of plural distinct settings. Alternatively, the variable time interval may be randomly selected, for example by electronic circuitry.

Timing mechanism 48 may be activated or set by any suitable action. Alternatively, or in addition to rotation used by timing mechanism 48, the timing mechanism may be set by depressing and/or holding down a button(s), by flipping a switch(es), pulling a lever, and/or the like.

Figure 10:
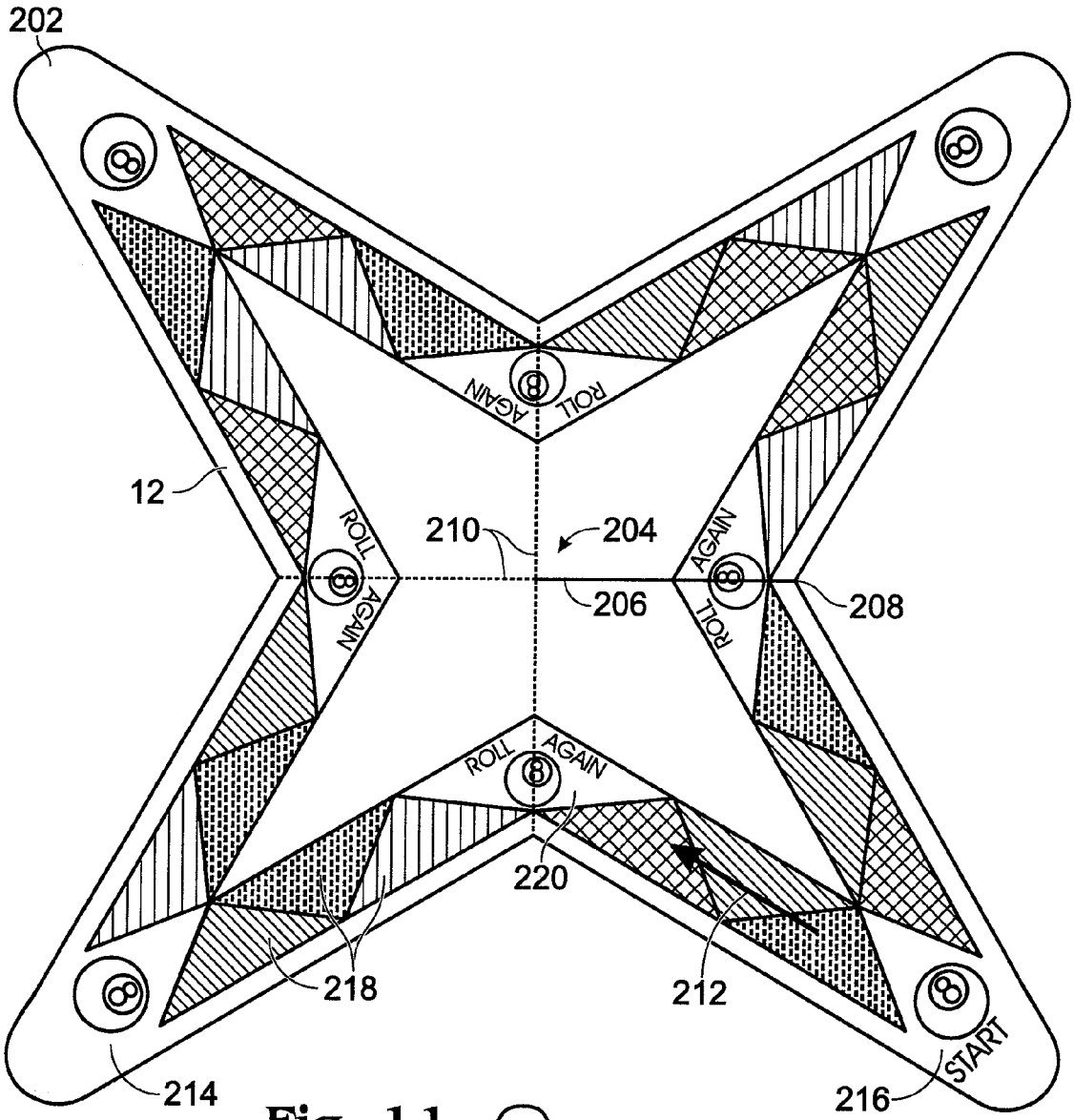
FIG. 10 is a top plan view of a game board used in the game of FIG. 1.

FIG. 10 shows game board 12 in greater detail. Game board 12 may have a star-shaped structure, for example, with four points 202 that are rounded, pointed, multi-sided, etc. To facilitate folding and storing game board 12, the board may include folding structure 204, for example, slit 206, extending from an inner corner 208 to a central position, and fold lines 210. Accordingly, board 12 may be converted from an unfolded to a one-quarter sized, folded configuration by folding along folding structure 204.

Game board 12 includes a path 212 along which player markers 14 may be moved around the board's perimeter. In the depicted embodiment, path 212 extends between and includes each of four corner positions 214, including a "START" position, shown at 216. Between each adjacent pair of corner positions 214, path 212 travels through seven defined positions: six colored spaces 218, and an inside corner position 220 or "ROLL AGAIN" space. Colored spaces 218 may have a plurality of distinct colors (or patterns or symbols), which correspond to the colors (or patterns or symbols) on one of a plurality of different groups of activity cards 18 (see FIG. 1).

Figure 11:
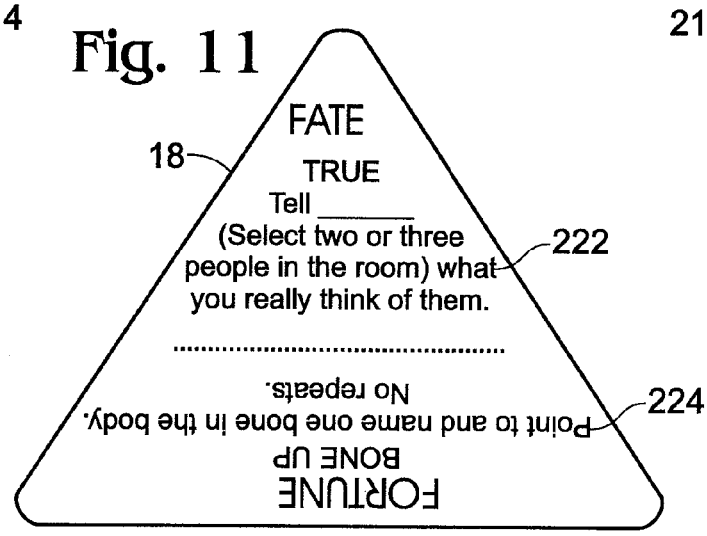
FIG. 11 is a bottom plan view of an activity card used in the game of FIG. 1.

FIG. 11 shows an example of an activity card 18. Activity cards 18 may be selected from card stacks 20 in response to a player's marker 14 landing on one of colored spaces 218. When activity card 18 is selected from a pile and inverted, card 18 may include text that directs two distinct activities, a "Fate" activity 222, and a "Fortune" activity 224. For example, the card of FIG. 11 directs the following Fate activity: "Tell _____ (select two or three people in the room) what you really think of them." Thus, player inputs may help define the nature or specific aspects of a Fate or Fortune activity. The exemplary Fortune activity of FIG. 11 is as follows: "BONE UP—Point to and name one bone in the body. No repeats." As shown by these examples, Fate and Fortune activities may be carried out by a single player, or plural players, either serially or in parallel. Fortune and Fate activities request a response from a player(s), for example, an audible response, such as speech, singing, whistling, humming, grunting, drumming, tapping, and so on. Spoken answers may be in response to a specific question and may be one of many possible answers, such as in the Fortune activity of FIG. 11. Alternatively, or in addition, Fortune or Fate activities may include a non-audible response, such as body movements, including hand motions, dancing, pantomiming, and so on.

Example

Rules for Game Play

The following example describes additional aspects of game 10, including rules for game play using die-rolling device 30, game board 12, player markers 14, tokens 16, and activity cards 18. This example is included for illustration and is not intended to limit or define the entire scope of the invention.

A. Set Up

Each player selects a player marker 14 and eight matching tokens 16. For shorter games, fewer tokens may be used. Activity cards 18 are divided according to color and thus separated into four piles 20. The piles are placed face down beside the four inner corners 208 of board 12. Die-rolling device 30 is placed in the middle of board 12. All player markers 14 are placed on START position 216.

B. Fortune Round

Play begins with the Fortune round. The object of the Fortune round is for each player to keep as many of his/her tokens 16 as possible.

To determine who plays first, each players says "MAGIC 8 BALL®, will I go first?" and turns over die-rolling device 30 to select a die face 112. Each player notes visual indicator 114 (yes/no answer) and the numerical output 116 provided by die-rolling device 30. The player that selects the highest numerical output goes first. Any ties are broken by consulting die-rolling device 30. (NOTE: if at any time during the game, a player gets an ambiguous answer (an indefinite response 118), such as "Ask Again," the player inverts die-rolling device 30 again to select a die face 112 and its associated outputs.

On each player's turn, the player consults die-rolling device 30 to determine the number of spaces to be moved. Spaces correspond to discrete positions along path 212 (corner positions 214, colored spaces 218, and inside corner positions 220). A die face 112 is selected by inverting die-rolling device 30, and the presented numerical output 116 directs a corresponding clockwise movement along path 212 by the player's marker 14. If the player's marker 14 lands on a colored space 218, the player draws an activity card 18 from pile 20 that matches the color of the colored space. The Fortune activity 224 of card 18 is then read out loud. (NOTE: Fortune activities are always group play. Each player participates when die-rolling device 30 is passed to him or her.)

As soon as the Fortune activity is read, timing mechanism 48 of die-rolling device 30 is activated by rotating upper portion 32 and the Fortune activity starts. Fortune activities begin with the player who drew activity card 18. This first player completes the activity and then passes die-rolling device 30 to the next player. Each player completes the activity in turn. This activity session ends once the endpoint is signaled by signaling mechanism 180, a player cannot think of an answer, repeats an answer, answers incorrectly, or performs the activity incorrectly. The player who fails to complete the activity forfeits a token 16. All forfeited tokens are placed in the center of board 12. Play continues clockwise to other players.

In the Fortune round of play, landing on a corner position 214 of board 12 gives a player immunity to forfeiting tokens 16 for as long as the player remains on the corner position. However, the player participates in any Fortune activity while on the corner position, but is not in danger of losing a token.

In the Fortune round of play, if a player (with more than one token remaining) cannot perform/complete an activity, the player may play "double or nothing" by asking die-rolling device 30 if the player should forfeit the token. If die-rolling device 30 provides a negative response, the player may keep the endangered token. However, if die-rolling device 30 provides an affirmative response, the player should forfeit two tokens.

Each stack of cards 18 may include one or more special cards ("Magic 8-Ball Cards") that lack Fortune/Fate activities. If a first player selects one of these special cards, the first player may keep the special card for later play. When the first player cannot successfully complete a Fortune activity, the first player may play the special card against any other second player, forcing the second player to forfeit a token in place of the first player. However, this second player may also have a special card, and also may choose to play the special card against any other player, forcing that other player to forfeit a token instead, and so on. However, each player that wishes to force another player to forfeit a token in his/her place should play his/her special card before another player draws a card from card stack 20. In addition, no more than one special card may be played against a given player in one turn. Rather than play a special card during the Fortune round a player may save it for play during the Fate round (see below).

The Fortune round ends when any player travels around board 12 along path 212 and returns to, or passes, START position 216. Each player then counts his or her remaining tokens 16. The player with the most remaining tokens wins the Fortune round and becomes the first "Great 8 Potentate." If two players tie with the most remaining tokens 16, both use die-rolling device 30 to select a numerical output 116. The player with the highest selected number becomes the Great 8 Potentate.

C. Fate Round

The object of the Fate round is to be the first player to win back all of his or her forfeited tokens 16. During the Fate round the player who is the current Great 8 Potentate is the master and keeper of die-rolling device 30.

Each player returns to START position 216. In the same order of play as used in the Fortune round, but skipping the current Great 8 Potentate, players use die-rolling device 30 to select a numerical output 116, and move a corresponding number of spaces along path 212.

In the Fate round, the Great 8 Potentate draws activity cards 18 for each of the other players, when dictated by the position of marker 14, and reads the Fate activity 222 of the card out loud. The Great 8 Potentate fills in any blanks, generally with silly or funny suggestions. The player for whom the Great 8 Potentate reads the Fate challenge should do exactly what the Great 8 Potentate suggests in order to win back a token 16, or a player may pass. If the player elects not to complete the Fate activity, the Great 8 Potentate may win back one of his or her own tokens 16 by completing the Fate activity. The Great 8 Potentate should complete the Fate activity to the satisfaction of all the other players to win back a token 16. Fate activities are individual play. Only the player whose turn it is to win back a token (or the Great 8 Potentate) is allowed to complete the activity.

If a player lands on one of corner positions 214, by exact count, the player automatically becomes the new Great 8 Potentate. The player takes die-rolling device 30 from the former Great 8 Potentate and switches the positions of markers 14 belonging to the former and new Great 8 Potentates.

If a player lands on an inside corner position 220, by exact count, during the Fate round of play, the player chooses one of the following two questions to ask die-rolling device 30:

1. May I win back a token?
2. Am I the next Great 8 Potentate?

The visual indicator 114 (yes/no response) selected by die-rolling device 30 answers the question asked.

In the Fate round of play, when the Great 8 Potentate draws a special card instead of a Fortune/Fate activity card 18, the player for whom the card was drawn may play the special card in one of two ways. First, the player may avoid his or her Fate activity and redeem a token for free. Second, the player may ask die-rolling device 30: "am I the next Great 8 Potentate?" A positive response unseats the Great 8 Potentate. This second option also is available to a player that has saved a special card from the Fortune round. In this case, the player may play the special card before the Great 8 Potentate draws a card for the player.

The winner of the game is the player that first wins back all of his or her tokens 16.

Although the invention has been disclosed in its preferred forms, the specific embodiments thereof as disclosed and illustrated herein are not to be considered in a limiting sense, because numerous variations are possible. The subject matter of the invention includes all novel and non-obvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to any earlier claims, also are regarded as included within the subject matter of the invention.

We claim:

1. A game comprising:

a game board, the game board defining a path having a plurality of discrete positions along the path;

a plurality of markers, each marker being configured to be used with the game board;

a plurality of tokens, a set of tokens being provided to each of the players;

a set of activity cards, each of the activity cards defining a first activity operable during a first portion of a game and a second activity operable during a second portion of the game, the first activity on an activity card being configured to be performed by a plurality of players sequentially during the first game portion after the activity card has been selected, the second activity on an activity card being configured to be performed by one of the plurality of players during the second portion of the game, the first portion of the game involving the forfeiture of tokens by players based on failure to perform activities by the players, and the second portion of the game involving the winning back of tokens by players based on the performance of activities by the players; and a die-rolling device including a die-rolling mechanism configured to randomly select and display an output from a set of outputs; and a timing mechanism configured to measure a time interval and to signal an end of the time interval, the die-rolling mechanism coupled to the timing mechanism within the die-rolling device.

2. The game of claim 1, wherein at least one of the plurality of discrete positions along the path gives a player immunity from forfeiting tokens during the first game portion as long as the marker of that player remains on the at least one of the plurality of discrete positions.

3. The game of claim 1, wherein the discrete positions include at least one position that has a first function during the first game portion and a second function during the second game portion, the second function being different than the first function.

4. The game of claim 1, wherein the time interval defines a period of time for the performance of an activity identified on an activity card, and the timing mechanism generates an audible output at an end of the period of time.

5. The game of claim 1, further comprising:

at least two sets of cards, each of the cards in a set including the same one of a color, a pattern, and a symbol as the other cards in the set, each of the discrete positions of the path includes one of a color, a pattern and a symbol, the one of a color, a pattern, and a symbol of a set of cards corresponding to the one of a color, a pattern, and a symbol of at least one of the discrete positions.

6. The game of claim 1, wherein the path includes a start position, and the first portion of the game ends when a player's marker reaches the start position.

7. The game of claim 1, wherein actuation of the die-rolling mechanism activates the timing mechanism.

8. A method of playing a game, comprising:

providing a marker and a set of tokens for each of a plurality of players;

selecting faces of a die;

moving the markers of the players along a path defined by a game board according to the selected faces of the die;

selecting a card from a set of cards when a marker lands on a discrete position along the path;

performing an activity identified on each the selected card, each identified activity being performed by a plurality of players in sequence;

forfeiting tokens when players fail to perform the activities identified on the selected cards during a first portion of the game; and winning back tokens when players perform the activities identified on the selected cards during a second portion of the game.

9. The method of claim 8, wherein the winning back tokens determines a winner of the game.

10. The method of claim 8, wherein each of the players begins the game with a predefined number of tokens, and the game ends when one of the players wins back every token forfeited by that player during the first portion of the game.

11. The method of claim 8, wherein the selecting faces of a die is performed using a device having a die-rolling mechanism coupled to a timing mechanism, and the performing activities includes measuring a time interval using the timing mechanism.

12. The method of claim 11, wherein the forfeiting tokens includes forfeiting a token by a player who fails to perform an activity identified on a selected card during the time interval.

13. The method of claim 11, wherein an end of the time interval determines when the performing an activity identified on the selected card ends.

14. The method of claim 8, wherein one or more of the cards includes a first activity and a second activity, and the performing activities includes performing the first activity during the first portion of the game, and performing the second activity during the second portion of the game.

15. The method of claim 8, wherein the performing activities includes providing an audible response.

16. A method of playing a game using a game board with a path having an initial position and discrete positions along the path, and a marker and a set of tokens for each of the players, the method comprising:

selecting faces of a die;

moving the markers of players along the path according to the selected faces of the die;

selecting a card from a set of cards when a marker of a player lands on a discrete position on the path;

for each selected card, communicating an activity defined on the selected card to the players;

starting a timing mechanism to define a period of time;

performing by each of the players sequentially the activity defined on the selected card until the period of time elapses or a player fails to perform the activity;

determining which of the players failed to perform the activity on the selected card within the period of time; and causing the player who failed to perform to forfeit a token; and determining which of the players has the most tokens remaining when a player's marker reaches the initial position.

17. The method of claim 16, wherein the game includes at least two sets of cards, each of the discrete positions of the path includes one of a color, a pattern and a symbol, each of the cards includes one of a color, a pattern and a symbol corresponding to the discrete positions, and the selecting a card includes selecting a card based on the one of a color, a pattern and a symbol of the discrete position on which the marker of the player lands.

18. The method of claim 16, wherein the determining which of the players has the most tokens remaining ends a first portion of the game and determines the winner of the first portion of the game.

19. The method of claim 16, wherein after the determining which of the players has the most tokens remaining, the method further comprises:

for each selected card, communicating an activity defined on the selected card to a particular player whose marker lands on a discrete position on the path;

performing by the particular player the activity identified on the selected card; and providing the particular player with a token if the particular player performs the activity; and determining which of the players is the first player to win back all of that player's forfeited tokens.

* * * * *